US009790622B2

(12) United States Patent
Knoff et al.

(10) Patent No.: US 9,790,622 B2
(45) **Date of Patent: *Oct. 17, 2017**

(54) COPOLYMER FIBERS AND YARNS AND PROCESSES FOR MAKING SAME

(71) Applicant: E I DU PONT DE NEMOURS AND COMPANY, Wilmington, DE (US)

(72) Inventors: Warren Francis Knoff, Richmond, VA (US); Christopher William Newton, Richmond, VA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/281,940

(22) Filed: Sep. 30, 2016

(65) Prior Publication Data

US 2017/0016145 A1 Jan. 19, 2017

Related U.S. Application Data

(62) Division of application No. 13/349,634, filed on Jan. 13, 2012, now Pat. No. 9,481,946.

(Continued)

(51) Int. Cl.
*D01D 5/04* (2006.01)
*D01D 5/12* (2006.01)

(Continued)

(52) U.S. Cl.
CPC ..... *D01D 5/04* (2013.01); *D01D 5/12* (2013.01); *D01D 10/02* (2013.01); *D01D 10/06* (2013.01);

(Continued)

(58) Field of Classification Search
CPC D01D 5/04; D01D 5/12; D01D 10/02; D01D 10/06

(Continued)

(56) References Cited

U.S. PATENT DOCUMENTS 3,227,793 A 1/1966 Cipriani
3,414,645 A 12/1968 Morgan (Continued)

FOREIGN PATENT DOCUMENTS

RU 2045586 10/1995
WO 2005/054337 6/2005
WO 2008/061668 5/2008

OTHER PUBLICATIONS

Shchetinin, et al., "The pseudoeffect of the hydrogen chloride contained in the aramid fibres SVM. Armos, and Rusar on their properties during the prolonged storage and use", Fibre chemisstry, vol. 38, No. 6, 2006.

(Continued)

*Primary Examiner* — Christina Johnson
*Assistant Examiner* — Xue Liu

(57) ABSTRACT

The present invention concerns methods for obtaining high-tenacity aramid yarn, wherein the yarn is made of a copolymer obtained from a mixture of monomers comprising 5-(6)-amino-2-(p-aminophenyl)benzimidazole, an aromatic para-diamine, and an aromatic para-diacid; the method comprising: a) spinning said copolymer from an inorganic acid solvent to produce the aramid yarn; b) washing said yarn with a basic aqueous solution for at least 5 seconds; and c) heating said yarn; wherein the yarn is heated in at least two process steps, characterized in that (i) in a first step the yarn is heated at a temperature of 200 to 360° C. at a tension of at least 0.2 cN/dtex, followed by (ii) a second step wherein the yarn is heated at a temperature of 370 to 500° C. at a tension of less than 1 cN/dtex. In some embodiments, the yarn has an effective polymer cation to sulfur content molar ratio of at least 0.3. In some embodiments, the yarn has a hydrolytic strength retention of the yarn is greater than 60%.

5 Claims, 2 Drawing Sheets

Related U.S. Application Data

(60) Provisional application No. 61/432,348, filed on Jan. 13, 2011.

(51) Int. Cl.

| | |
|---|---|
| ***D01D 10/02*** | (2006.01) |
| ***D01D 10/06*** | (2006.01) |
| ***D01F 6/80*** | (2006.01) |
| ***D01F 6/90*** | (2006.01) |
| ***D02G 1/02*** | (2006.01) |

(52) U.S. Cl.
CPC ..... *D01F 6/80* (2013.01); *D01F 6/805* (2013.01); *D01F 6/905* (2013.01); *D02G 1/02* (2013.01); *D10B 2401/063* (2013.01)

(58) Field of Classification Search
USPC ..... 264/184
See application file for complete search history.

(56) References Cited

U.S. PATENT DOCUMENTS

| | | | |
|---|---|---|---|
| 3,767,756 | A | 10/1973 | Blades |
| 4,018,735 | A | 4/1977 | Nakagawa et al. |
| 5,571,891 | A | 11/1996 | Jung et al. |
| 5,667,743 | A | 9/1997 | Tai et al. |
| 2010/0029159 | A1 | 2/2010 | Ishihara et al. |

OTHER PUBLICATIONS

Sugak, V.N., "Fabrication of Fibres from Sulfuric Acid Solucaitons of CoPolyamides Containing Polyamaide-Benzimidale Units and Their Heat Treatment", 1999, vol. 31, No. 1.

PCT International Search Report and Written Opinion for International Application No. PCT/US2012/021259, dated Mar. 28, 2012.

PCT International Search Report and Written Opinion for International Application No. PCT/US2012/021267, dated Mar. 28, 2012.

PCT International Search Report and Written Opinion for International Application No. PCT/US2012/021208, dated Apr. 20, 2012.

PCT International Search Report and Written Opinion for International Application No. PCT/US2012/021220, dated Apr. 25, 2012.

COPOLYMER FIBERS AND YARNS AND PROCESSES FOR MAKING SAME

TECHNICAL FIELD

The present application concerns fibers and yarns composed of copolymers containing a significant amount of monomers that have imidazole functionality which have long term hydrolytic stability and methods of producing such fibers and yarns.

BACKGROUND

Advances in polymer chemistry and technology over the last few decades have enabled the development of high-performance polymeric fibers. For example, liquid-crystalline polymer solutions of rigid-rod and semi-rigid-rod polymers can be formed into high strength fibers by spinning liquid-crystalline polymer solutions into dope filaments, removing solvent from the dope filaments, washing and drying the fibers; and if desired, further heat treating the dried fibers. One example of high-performance polymeric fibers is para-aramid fiber such as poly (paraphenylene terephthalamide) ("PPD-T" or "PPTA").

Fiber strength is typically correlated to one or more polymer parameters, including composition, molecular weight, intermolecular interactions, backbone, residual solvent or water, macromolecular orientation, and process history. For example, fiber strength typically increases with polymer length (i.e., molecular weight), polymer orientation, and the presence of strong attractive intermolecular interactions. As high molecular weight rigid-rod polymers are useful for forming polymer solutions ("dopes") from which fibers can be spun, increasing molecular weight typically results in increased fiber strength.

Fibers derived from 5(6)-amino-2-(p-aminophenyl) benzimidazole, para-phenylenediamine and terephthaloyl dichloride are known in the art. Hydrochloric acid is produced as a by-product of the polymerization reaction. The majority of the fibers made from such copolymers have generally been spun directly from the polymerization solution without further treatment. Such copolymers are the basis for a high strength fibers manufactured in Russia, for example, under the trade names Armos® and Rusar®. See, Russian Patent Application No. 2,045,586. However, the copolymer can be isolated from the polymerization solvent and then redissolved in another solvent, typically sulfuric acid, to spin fibers.

Previously, it was not appreciated that fibers derived from copolymers of 5(6)-amino-2-(p-aminophenyl)benzimidazole, para-phenylenediamine and terephthaloyl dichloride, when spun from sulfuric acid solutions, are exceedingly difficult to neutralize effectively; these fibers retain that sulfuric acid to a much higher degree than other aramid homopolymers. There is a wealth of art teaching that fiber made from sulfuric acid solutions of the aramid homopolymer poly (paraphenylene terephthalamide) can be neutralized/washed quickly and easily because that homopolymer does not have appreciable sites for linkage to the sulfuric acid. Copolymers of 5(6)-amino-2-(p-aminophenyl) benzimidazole, para-phenylenediamine and terephthaloyl dichloride, because of the imidazole functionality, have multiple site that it is believed actually bind the sulfuric acid to the polymer chain. Prior neutralization/washing techniques used for typical homopolymer fiber processing are therefore not adequate for these copolymer fibers.

It is further believed that the copolymer fiber must be sufficiently washed and neutralized to remove essentially all of the sulfuric acid in order to provide a fiber and/or yarn having long-term hydrolytic stability. Therefore, what is needed are new methods to wash and neutralize these copolymer fibers.

Known processes for making copolymer fibers directly from polymerization solution, while producing a good product for use in ballistic and other aramid end-uses, are very expensive with very poor investment economics. As such, there is a need in the art for manufacturing process wherein the copolymer is solutioned in a common solvent, such as sulfuric acid which has both improved economics compared to processes known in the art and provides copolymer fibers having superior long-term physical properties.

SUMMARY

In some embodiments, the invention concerns methods for obtaining high-tenacity aramid yarn, wherein the yarn is made of a copolymer obtained from a mixture of monomers comprising 5-(6)-amino-2-(p-aminophenyl)benzimidazole, an aromatic para-diamine, and an aromatic para-diacid; the method comprising: a) spinning the copolymer from an inorganic acid solvent to produce the aramid yarn; b) washing the yarn with a basic aqueous solution for at least 5 seconds; and c) heating the yarn; wherein the yarn is heated in at least two process steps, characterized in that (i) in a first step the yarn is heated at a temperature of 200 to 360° C. at a tension of at least 0.2 cN/dtex, followed by (ii) a second step wherein the yarn is heated at a temperature of 370 to 500° C. at a tension of less than 1 cN/dtex. In some embodiments, the yarn has an effective polymer cation to sulfur content molar ratio of at least 0.3. The effective polymer cation to sulfur content molar ratio is defined as the value of the sum of sodium (Na) content plus two times the calcium (Ca) content plus the potassium (K) content minus the chlorine (Cl) content, that sum divided by the sulfur (S) content in the yarn. That is:

$$\text{Effective Poylmer Cation to Sulfur Content Molar Ratio} = \frac{([Na] + 2[Ca] + [K] - [Cl])}{[S]},$$

where the symbols [Na], [Ca], [K], [Cl], and [S] are the concentration of these ions in moles/kilogram of polymer.

In some embodiments, the yarn has a hydrolytic strength retention of the yarn is greater than 60%.

In some embodiments, the sulfuric acid is at least 96%, 98% or 100%.

One preferred copolymer is obtained from a mixture of monomers at least comprising 5-(6)-amino-2-(p-aminophenyl)-benzimidazole, terephthaloyl dichloride and/or 2-chloroterephthaloyl dichloride, and p-phenylene diamine and/or 2-chloro-p-phenylenediamine.

In some embodiments, the effective polymer cation to sulfur content molar ratio is at least 1.0. In other embodiments, the effective polymer cation to sulfur content molar ratio is at least 1.5.

In some processes, the basic aqueous solution comprises sodium hydroxide. In certain processes, the yarn is washed the basic aqueous solution for a time period greater than 20 seconds.

In some embodiments, the process further comprises washing the yarn with water before and after contacting the yarn with the basic aqueous solution. In some examples the neutralization solution is an aqueous solution containing 0.01 to 1.25 mols of base per liter, preferably 0.01 to 0.5 mols of base per liter.

In some preferred processes, the yarn, after the first heating step, is directly led to a heating device for performing the second heating step without winding and unwinding the yarn between the two heating steps. For example, the first heating step may be performed at 240 to 330° C. at a tension of at least 3 cN/dtex. In some embodiments the second heating step may performed at 400 to 470° C. at a tension less than 0.5 cN/dtex.

BRIEF DESCRIPTION OF THE DRAWINGS

The foregoing summary, as well as the following detailed description, is further understood when read in conjunction with the appended drawings. For the purpose of illustrating the invention, there is shown in the drawings exemplary embodiments of the invention; however, the invention is not limited to the specific methods, compositions, and devices disclosed. In the drawings.

DETAILED DESCRIPTION OF ILLUSTRATIVE EMBODIMENTS

Figure 1:
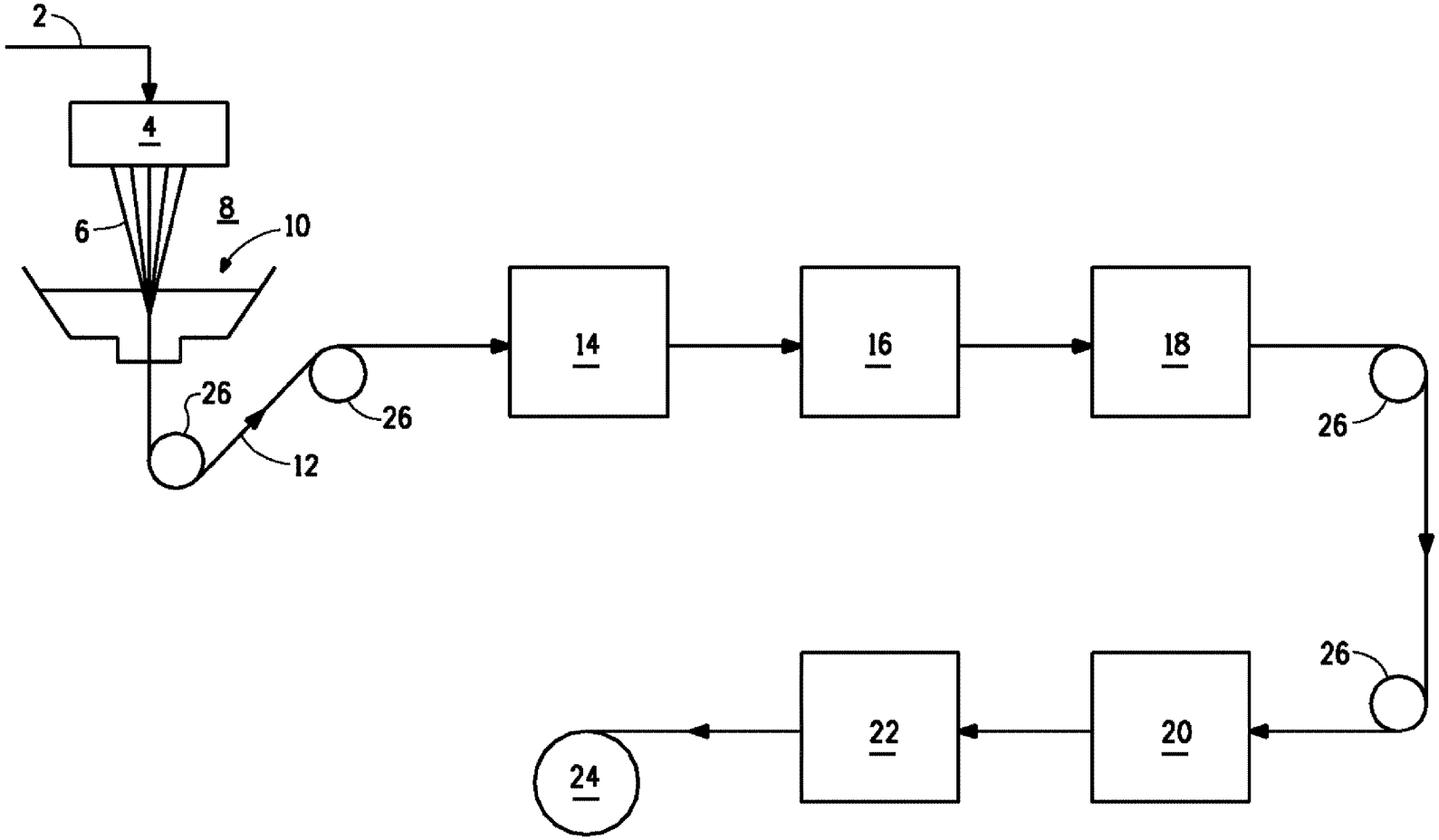
FIG. 1 is a schematic diagram of a fiber production process.

The present invention may be understood more readily by reference to the following detailed description taken in connection with the accompanying figures and examples, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

As used in the specification including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable. When any variable occurs more than one time in any constituent or in any formula, its definition in each occurrence is independent of its definition at every other occurrence. Combinations of substituents and/or variables are permissible only if such combinations result in stable compounds.

The present invention is related to a process which performs the polymerization of 5(6)-amino-2-(p-aminophenyl) benzimidazole, para-phenylenediamine and terephthaloyl dichloride at high solids (7 percent or greater) in NMP/$CaCl_2$ or DMAC/$CaCl_2$, isolates the copolymer crumb, dissolves the isolated copolymer crumb in concentrated sulfuric acid to form a liquid crystalline solution, and spins the solution into fibers. By "solids" it is meant the ratio of the mass of copolymer to the total mass of the solution, that is, the mass of the copolymer plus solvent.

The copolymerization reaction of 5(6)-amino-2-(p-aminophenyl) benzimidazole, para-phenylenediamine and terephthaloyl dichloride may accomplished by means known in the art. See, for example, PCT Patent Application No. 2005/054337 and U.S. Patent Application No. 2010/0029159. Typically, acid chloride and the aromatic diamines are reacted in an amide polar solvent such as N, N-dimethylformamide, N,N-dimethylacetamide, N-methyl-2-pyrrolidone, dimethylimidazolidinone and the like. N-methyl-2-pyrrolidone is preferred in some embodiments.

In some embodiments, before or during the polymerization, a solubility agent of an inorganic salt such as lithium chloride or calcium chloride, or the like is added in a suitable amount to enhance the solubility of the resulting copolyamide in the amide polar solvent. Typically, 3 to 10% by weight relative to the amide polar solvent is added. After the desired degree of polymerization has been attained, the copolymer is present in the form of an un-neutralized crumb. By "crumb" it is meant the copolymer is in the form of a friable material or gel that easily separates into identifiable separate masses when sheared. The un-neutralized crumb includes the copolymer, the polymerization solvent, the solubility agent and the byproduct water and acid from the condensation reaction, typically hydrochloric acid (HCL).

After completing the polymerization reaction, the un-neutralized crumb is then contacted with a base, which can be a basic inorganic compound, such as sodium hydroxide, potassium hydroxide, calcium hydroxide, calcium oxide, ammonium hydroxide, and the like, generally in aqueous form, is added to perform a neutralization reaction of the HCl by-product. If desired, the basic compound can be an organic base such as diethyl amine or tributyl amine or other amines. Generally the un-neutralized copolymer crumb is contacted with the aqueous base by washing, which converts the acidic byproduct to a salt (generally a sodium chloride salt if sodium hydroxide is the base and HCl is the acidic byproduct) and also removes some of the polymerization solvent. If desired, the un-neutralized copolymer crumb can be optionally first washed one or more times with water prior to contacting with the basic inorganic compound to remove excess polymerization solvent. Once the acidic byproduct in the copolymer crumb is neutralized, additional water washes can be employed to remove salt and polymerization solvent and lower the pH of the crumb, if needed.

This invention also relates to a process for forming an aramid yarn comprising dissolving a copolymer crumb derived from the copolymerization of para-phenylenediamine, 5(6)-amino-2-(p-aminophenyl)benzimidazole; and terephthaloyl dichloride in sulfuric acid to form a spinning solution, wherein the copolymer crumb is neutralized prior to forming said spinning solution; said copolymer having an inherent viscosity of at least 3 dl/g and having less than 0.4 mol/Kg of titrate-able acid. In one preferred embodiment, the copolymer crumb is neutralized by washing with an aqueous base. Terephthaloyl dichloride is also known as terephthaloyl chloride.

The copolymer is preferably spun into fiber using solution spinning. Generally this involves solutioning the neutralized copolymer crumb in a suitable solvent to form a spin solution (also known as spin dope), the preferred solvent being sulfuric acid. The inventors have found that the use of copolymer crumb that has been neutralized as described herein dramatically reduces the formation of bubbles in the spin dope when such neutralized crumb is combined with sulfuric acid in the solutioning process. If the copolymer crumb is not neutralized, the hydrochloric acid by-product in the copolymer will volatize on contact with the sulfuric acid and form bubbles in the spin dope. Since the solution viscosity of the spin dope is relatively high, any such bubbles that are formed during solutioning tend to stay in the spin dope and are spun into the filaments. The neutralized copolymer crumb, when solutioned in sulfuric acid, provides an essentially bubble-free and therefore more uniform spinning solution which is believed to provide more uniformly superior copolymer filaments and fibers.

The spin dope containing the copolymer described herein can be spun into dope filaments using any number of processes; however, wet spinning and "air-gap" spinning are the best known. The general arrangement of the spinnerets and baths for these spinning processes is well known in the art, with the figures in U.S. Pat. Nos. 3,227,793; 3,414,645; 3,767,756; and 5,667,743 being illustrative of such spinning processes for high strength polymers. In "air-gap" spinning the spinneret typically extrudes the fiber first into a gas, such as air and is a preferred method for forming filaments It is believed that in addition to producing the spinning dope with neutralized copolymer crumb, for the best fiber properties, the manufacturing process of spinning fibers from an acid solvent should additionally include not only steps that extract acid solvent from the dope filaments but also further remove and/or neutralize any remaining acid associated with or bound to the copolymer in the fiber. It is believed that failure to do this can result in more potential degradation of the copolymer in the fiber and subsequent decrease in fiber mechanical properties over time.

One process for making copolymer yarns is shown in FIG. 1. The dope solution 2, comprising copolymer and sulfuric acid, typically contains a high enough concentration of polymer for the polymer to form an acceptable filament 6 after extrusion and coagulation. When the polymer is lyotropic liquid-crystalline, the concentration of polymer in the dope 2 is preferably high enough to provide a liquid-crystalline dope. The concentration of the polymer is preferably at least about 7 weight percent, more preferably at least about 10 weight percent and most preferably at least about 14 weight percent.

The polymer dope solution 2 may contain additives such as anti-oxidants, lubricants, ultra-violet screening agents, colorants and the like which are commonly incorporated.

The polymer dope solution 2 is typically extruded or spun through a die or spinneret 4 to prepare or form the dope filaments 6. The spinneret 4 preferably contains a plurality of holes. The number of holes in the spinneret and their arrangement is not critical, but it is desirable to maximize the number of holes for economic reasons. The spinneret 4 can contain as many as 100 or 1000, or more, and they may be arranged in circles, grids, or in any other desired arrangement. The spinneret 4 may be constructed out of any materials that will not be severely degraded by the dope solution 2.

The spinning process of FIG. 1 employs "air-gap" spinning (also sometimes known as "dry-jet" wet spinning). Dope solution 2 exits the spinneret 4 and enters a gap 8 (typically called an "air gap" although it need not contain air) between the spinneret 4 and a coagulation bath 10 for a very short duration of time. The gap 8 may contain any fluid that does not induce coagulation or react adversely with the dope, such as air, nitrogen, argon, helium, or carbon dioxide. The dope filament 6 proceeds across the air gap 8, and is immediately introduced into a liquid coagulation bath. Alternately, the fiber may be "wet-spun" (not shown). In wet spinning, the spinneret typically extrudes the fiber directly into the liquid of a coagulation bath and normally the spinneret is immersed or positioned beneath the surface of the coagulation bath. Either spinning process may be used to provide fibers for use in the processes of the invention. In some embodiments of the present invention, air-gap spinning is preferred.

The filament 6 is "coagulated" in the coagulation bath 10 containing water or a mixture of water and sulfuric acid. If multiple filaments are extruded simultaneously, they may be combined into a multifilament yarn before, during or after the coagulation step. The term "coagulation" as used herein does not necessarily imply that the dope filament 6 is a flowing liquid and changes into a solid phase. The dope filament 6 can be at a temperature low enough so that it is essentially non-flowing before entering the coagulation bath 10. However, the coagulation bath 10 does ensure or complete the coagulation of the filament, i.e., the conversion of the polymer from a dope solution 2 to a substantially solid polymer filament 12. The amount of solvent, i.e., sulfuric acid, removed during the coagulation step will depend on the residence time of the filament 6 in the coagulation bath, the temperature of the bath 10, and the concentration of solvent therein. For example, using a 18 weight percent copolymer/sulfuric acid solution at a temperature of about 23° C., a residence time of about one second will remove about 30 percent of the solvent present in the filament 6.

After the coagulation bath, the fiber may be contacted with one or more washing baths or cabinets 14. Washes may be accomplished by immersing the fiber into a bath or by spraying the fiber with the aqueous solution. Washing cabinets typically comprise an enclosed cabinet containing one or more rolls which the yarn travels around a number of times, and across, prior to exiting the cabinet. As the yarn 12 travels around the roll, it is sprayed with a washing fluid. The washing fluid is continuously collected in the bottom of the cabinet and drained therefrom.

The temperature of the washing fluid(s) is preferably greater than 30° C. The washing fluid may also be applied in vapor form (steam), but is more conveniently used in liquid form. Preferably, a number of washing baths or cabinets are used. The residence time of the yarn 12 in any one washing bath or cabinet 14 will depend on the desired concentration of residual sulfur in the yarn 12. In a continuous process, the duration of the entire washing process in the preferred multiple washing bath(s) and/or cabinet(s) is preferably no greater than about 10 minutes, more preferably greater than about 5 seconds. In some embodiments the duration of the entire washing process is 20 seconds or more; in some embodiments the entire washing is accomplished in 400 seconds or less. In a batch process, the duration of the entire washing process can be on the order of hours, as much as 12 to 24 hours or more.

Neutralization of the sulfuric acid in the yarn can occur in bath or cabinet 16. In some embodiments, the neutralization bath or cabinet may follow one or more washing baths or cabinets. Washes may be accomplished by immersing the fiber into a bath or by spraying the fiber with the aqueous solution. Neutralization may occur in one bath or cabinet or in multiple baths or cabinets. In some embodiments, preferred bases for the neutralization of sulfuric acid impurity include NaOH; KOH; $Na_2CO_3$; $NaHCO_3$; $NH_4OH$; $Ca(OH)_2$; $K_2CO_3$; $KHCO_3$; or trialkylamines, preferably tributylamine; other amines; or mixtures thereof. In one embodiment, the base is water soluble. In some preferred examples the neutralization solution is an aqueous solution containing 0.01 to 1.25 mols of base per liter, preferably 0.01 to 0.5 mols of base per liter. The amount of cation is also dependent on the time and temperature of exposure to the base and the washing method. In some preferred embodiments, the base is NaOH or Ca $(OH)_2$.

After treating the fiber with base, the process optionally may include the step of contacting the yarn with a washing solution containing water or an acid to remove all or substantially all excess base. This washing solution can be applied in one or more washing baths or cabinets 18.

After washing and neutralization, the fiber or yarn 12 may be dried in a dryer 20 to remove water and other liquids. One or more dryers may be used. In certain embodiments, the dryer may be an oven which uses heated air to dry the fibers. In other embodiments, heated rolls may be used to heat the fibers. The fiber is heated in the dryer to a temperature of at least about 20° C. but less than about 100° C. until the moisture content of the fiber is 20 weight percent of the fiber or less. In some embodiments the fiber is heated to 85° C. or less. In some embodiments the fiber is heated under those conditions until the moisture content of the fiber is 14 weight percent of the fiber or less. The inventors have discovered that low temperature drying is a preferred route to improved fiber strength. Specifically, the inventors have found that the best fiber strength properties are achieved when the first drying step (i.e. heated roll, heated atmosphere as in an oven, etc.) experienced by the never-dried yarn is conducted at gentle temperatures not normally used in continuous processes used to dry high strength fibers on commercial scale. It is believed that the copolymer fiber has more affinity to water than PPD-T homopolymer; this affinity slows the diffusion rate of water out of the polymer during drying and consequently if the never-dried yarn is directly exposed to typical high drying temperatures, generally used to created a large thermal driving force and reduce drying time, irreparable damage to the fiber occurs resulting in lower fiber strength. In some embodiments, the fiber is heated at least to about 30° C.; in some embodiments the fiber is heated at least to about 40° C.

The dryer residence time is less than ten minutes and is preferably less than 180 seconds. The dryer can be provided with a nitrogen or other non-reactive atmosphere. The drying step typically is performed at atmospheric pressure. If desired, however, the step may be performed under reduced pressure. In one embodiment, the yarn is dried under tension of at least 0.1 gpd, preferably a tension of 2 gpd or greater.

Following the drying step, the fiber is preferably further heated to a temperature of at least 350° C. in, for instance, a heat setting device 22. One or more devices may be utilized. For example, such processing may be done in a nitrogen purged tube furnace 22 for increasing tenacity and/or relieving the mechanical strain of the molecules in the filaments. In some embodiments, the fiber or yarn is heated to a temperature of at least 400° C. In one embodiment, the yarn is further heated under tension of 1 gpd or less, using only enough tension to advance the yarn through the heating device.

In some embodiments, the heating is a multistep process. For example, in a first step the fiber or yarn may be heated at a temperature of 200 to 360° C. at a tension of at least 0.2 cN/dtex, followed by a second heating step where the fiber or yarn is heated at a temperature of 370 to 500° C. at a tension of less than 1 cN/dtex.

Finally, the yarn 12 is wound up into a package on a windup device 24. Rolls, pins, guides, and/or motorized devices 26 are suitably positioned to transport the yarn through the process. Such devices are well known in the art and any suitable device may be utilized.

Molecular weights of polymers are typically monitored by, and correlated to, one or more dilute solution viscosity measurements. Accordingly, dilute solution measurements of the relative viscosity ("$V_{rel}$" or "$\eta_{rel}$" or "$n_{rel}$") and inherent viscosity ("$V_{inh}$" or "$\eta_{inh}$" or "$n_{inh}$") are typically used for monitoring polymer molecular weight. The relative and inherent viscosities of dilute polymer solutions are related according to the expression $$V_{inh}=\ln(V_{rel})/C,$$

where ln is the natural logarithm function and C is the concentration of the polymer solution. $V_{rel}$ is a unitless ratio, thus $V_{inh}$ is expressed in units of inverse concentration, typically as deciliters per gram ("dl/g").

The invention is further directed, in part, to fabrics that include filaments or yarns of the present invention, and articles that include fabrics of the present invention. For purposes herein, "fabric" means any woven, knitted, or non-woven structure. By "woven" is meant any fabric weave, such as, plain weave, crowfoot weave, basket weave, satin weave, twill weave, and the like. By "knitted" is meant a structure produced by interlooping or intermeshing one or more ends, fibers or multifilament yarns. By "non-woven" is meant a network of fibers, including unidirectional fibers (if contained within a matrix resin), felt, and the like.

"Fiber" means a relatively flexible, unit of matter having a high ratio of length to width across its cross-sectional area perpendicular to its length. Herein, the term "fiber" is used interchangeably with the term "filament". The cross section of the filaments described herein can be any shape, but are typically circular or bean shaped. Fiber spun onto a bobbin in a package is referred to as continuous fiber. Fiber can be cut into short lengths called staple fiber. Fiber can be cut into even smaller lengths called floc. The term "yarn" as used herein includes bundles of filaments, also known as multifilament yarns; or tows comprising a plurality of fibers; or spun staple yarns. Yarn can be intertwined and/or twisted.

Test Methods

Accelerated Hydrolytic Stability as Measure by Strength Retention can be performed using the following methodology. Two 25 meter skeins of the sample to be evaluated are prepared. One skein is hung in an autoclave and treated with saturated steam at 150° C. for 24 hours. Both skeins are then conditioned for a minimum of 24 hours at 75° F. (23.0° C.) and 55% relative humidity. Specimens from each skein are twisted to a 33.7 twist factor (twist factor=turns/meter× square root (decitex)/100) on a hand twister and the break strength is measured according to the methods described in ASTM D885. Percent strength retention is computed by dividing the strength of the steam treated yarn by that of the untreated yarn and multiplying by 100.

Yarn tenacity is determined according to ASTM D885 and is the maximum or breaking stress of a fiber as expressed as either force per unit cross-sectional area, as in giga-Pascals (GPa), or in force per unit mass per length, as in grams per denier or grams per dtex.

Inherent viscosity is determined using a solution in which a polymer is dissolved in a concentrated sulfuric acid with a concentration of 96 wt % at a polymer concentration (C) of 0.5 g/dl and at a temperature of 25° C. Inherent viscosity is then calculated as ln $(t_{poly}/t_{solv})/C$ where $t_{poly}$ is the drop time for the polymer solution and $t_{solv}$ is the drop time of the pure solvent.

Moisture content of the fiber was obtained by first weighing the fiber sample, placing the sample in an oven at 300° C. for 20 minutes, then immediately re-weighing the sample. Moisture content is then calculated by substracting the dried sample weight from the initial sample weight and dividing by the dried sample weight times 100.

XRF Analysis of the sulfur, calcium, sodium, potassium and chloride are determined as follows.

Sample preparation—The aramid material was pressed into a 13 mm diameter tablet by a SPEX X-Press at 10 T of pressure for 1 minute.

XRF measurement—This measurement was performed with a Panalytical Axios Advanced X-ray fluorescence spectrometer and stainless steel sample holders for 13 mm tablets.

The following instrumental settings were applied:

X-Ray tube: Rhodium

Detector: Flow Counter for Ca, K, Cl, Na, S

Filter: None

Collimator Mask: 10 mm

Medium: Vacuum

The instrumental settings were as follows:

| Line | Voltage (kV) | Current (mA) | 2Θ angle (°) | Background Offset (°) | $T_p$ (s) | $T_b$ (s) | Crystal | Collimator (μm) | PHD (LL/UL) |
|---|---|---|---|---|---|---|---|---|---|
| Ca—Kα | 30 | 133 | 113.1612 | −1.500 | 50 | 20 | LiF 200 | 300 | 31/62 |
| K—Kα | 25 | 160 | 136.7514 | −1.7102 | 50 | 20 | LiF 200 | 300 | 34/57 |
| Cl—Kα | 25 | 160 | 92.9500 | +/−1.500 | 50 | 10 | Ge111 | 300 | 25/75 |
| S—Kα | 25 | 160 | 110.7828 | −1.4124 | 50 | 20 | Ge111 | 300 | 34/58 |
| Na—Kα | 25 | 160 | 28.2010 | +/−1.500 | 50 | 10 | PX1 | 300 | 25/75 |

The principle of quantification is based on a linear relationship of Na-, S-, Cl-, K- and Ca-Kα-fluorescence intensities with known concentrations to give a calibration line, which line is used to determine unknown concentrations.

The acid concentration in the yarn via titration is determined as follows. A sample of about 10 grams of the yarn is weighed out. 250 ml of distilled water and the yarn are added to a stainless steel beaker. 150 ml of 1 normal NaOH solution is added to the beaker. (NaOH solution added (ml)≡A) (Normality of NaOH solution≡B). The beaker is cover and placed on a hot plate inside of the hood and let boil for 15 minutes. The liquid and yarn is then allowed to cool to room temperature. The yarn is removed from the liquid and placed in a tared aluminum dish and immediately the yarn sample and aluminum dish are weighed together. (Wet yarn+pan weight (g) C) (Pan weight (g)≡D) The weight of the remaining liquid in the beaker is then weighed. (Liquid weight≡E) The wet yarn sample is then dried in a vacuum oven overnight and then the dried yarn is weighed with the pan. (Dry yarn+pan weight≡F)

10 grams of the remaining liquid in the beaker is then placed in a flask with a stir bar and stirred. Three drops of Bromthymol Blue indicator are then added to the flask. The sample is then titrated with 0.05 normal HCl. HCl is slowly added to the sample until the indicator color changes from blue to green/yellow. (Amount of 0.05N HCl titrant≡G) (Normality of HCl solution≡H) The percent acid in yarn is then calculated from the following equation:

$$\%\ \text{Acid in yarn} = \left[\frac{A\times B}{1000} - \frac{G\times H}{1000}\times\frac{(E+C-F)}{10}\right]\Big/ 2\times 98/(F-D)\times 100$$

EXAMPLES

Many of the following examples are given to illustrate various embodiments of the invention and should not be interpreted as limiting it in any way. All parts and percentages are by weight unless otherwise indicated.

General

A copolymer is made by coplomerizing the monomers para-phenylenediamine (PPD), 5(6)-amino-2-(p-aminophenyl) benzimidazole (DAPBI); and terephthaloyl dichloride (TCL). The DAPBI/PPD/TLC copolymer has a 70/30 DAPBI/PPD mole ratio and is dissolved in sulfuric acid at 20% solids and is spun using a dry jet wet spinning process similar to that used for para-aramid homopolymers. See, U.S. Pat. No. 3,767,756. The yarn consists of nine filaments, each filament having a nominal linear density of about 3 denier and the inherent viscosity of filament copolymer is about 4.25 dl/g. The sulfuric acid content of the unwashed yarn is about 50% as measured by titration. A number of 50 meter samples are then wound on individual tubes for further testing.

Example 1

One unwashed yarn specimen on the tube is placed in a continuously replenished overflowing deionized water bath at ~20° C. for 12 hours. The yarn specimen on the tube is then placed in contact with 1 liter 2.0 wt % sodium hydroxide in water water (0.5 mols NaOH per liter) for 1 hour. The yarn specimen is then placed in a continuously replenished overflowing deionized water bath at ~20° C. for 1 hours. Excess liquid is then removed from the yarn and it is dried in a tube oven at 160° C. The yarn is then heat treated under nitrogen in a first oven at 300° C. and 4.5 cN/dtex and then a second oven at 450° C. and 0.15 cN/dtex. Data on the approximate amount of the cations and their calculated concentrations is in Table 1. The effective polymer cation to sulfur content molar ratio is about 1, and expected hydrolytic strength retention is about 70%. In the table, the weight-percent, parts-per-million, and moles-per-kg are of the element in the yarn.

Comparative Examples A & B

For Comparative Example A, Example 1 is repeated on another unwashed yarn specimen on a tube; however, the 2.0 wt % sodium hydroxide in water solution is replaced with a 0.8 wt % sodium hydroxide in water solution (0.2 mols NaOH per liter). This reduction in the base concentration provides less neutralization power to the yarn. Data on the approximate amount of the cations and their calculated concentrations is in Table 1. The effective polymer cation to sulfur content molar ratio is about 0.1, and the expected hydrolytic strength retention is only about 40%.

For Comparative Example B, Example A is repeated, however, after washing with the 0.8 wt % sodium hydroxide in water solution, the second water wash is increased from a 1 hour wash to an 8 hour wash. Data on the approximate amount of the cations and their calculated concentrations is in Table 1. The effective polymer cation to sulfur content molar ratio is less than Comparative Example A (less than about 0.1), and expected hydrolytic strength retention is only about 30%. It is believed that the 0.8 wt % sodium hydroxide solution does not provide enough neutralizing power, and that additional washes after treatment simply removes the sodium hydroxide, indicating the slow kinetics of the neutralization of the copolymer.

TABLE 1

| | Example | | |
|---|---|---|---|
| | 1 | A | B |
| S (wt %) | 1 | 1.8 | 1.8 |
| Na (wt %) | 0.7 | 0.2 | 0.1 |
| Ca (ppm) | 35 | 35 | 35 |
| K (ppm) | 20 | 20 | 10 |
| Cl (ppm) | 100 | 100 | 100 |
| S (moles/kg) | 0.3 | 0.6 | 0.6 |
| Na (moles/kg) | 0.3 | 0.1 | 0.4 |
| Ca (moles/kg) | Trace | Trace | Trace |
| K (moles/kg) | Trace | Trace | Trace |
| Cl (moles/kg) | Trace | Trace | Trace |
| [Na] + 2[Ca] + [K] − [Cl]/[S] | ~1.0 | ~0.1 | <0.1 |
| Expected Hydrolytic Stength Retention (%) | 70 | 40 | 30 |

Example 2

Example 1 is repeated, however the initial water wash is reduced from 12 hours to 8 hours. The effective polymer cation to sulfur content molar ratio is about 0.5, and the expected hydrolytic strength retention is about 55%, less than Example 1, reflecting the impact of the first water wash.

Example 3

Example 1 is repeated, however the initial water wash is increased from 12 hours to 16 hours. The effective polymer cation to sulfur content molar ratio is about 2, and the expected hydrolytic strength retention is about 80%, more than Example 1, reflecting the impact of the first water wash.

Example 4

Figure 2:
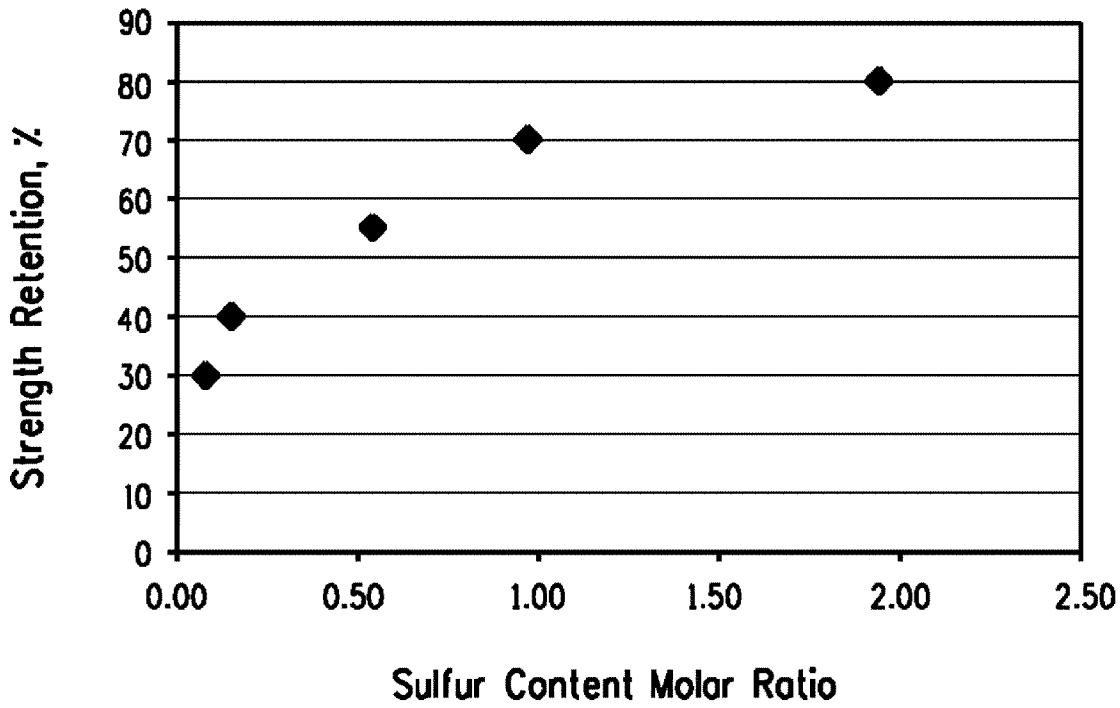
FIG. 2 presents a plot of % strength retention under hydrolysis conditions of the fiber versus the effective cation to sulfur content molar ratio ([Na]+2 [Ca]+[K]−[Cl])/[S].

Example 1 is repeated, however the initial water wash is increased from 12 hours to 48 hours and the yarn is contacted with 1.0 wt % sodium hydroxide in water for 2 hours, versus the 2.0 wt % sodium hydroxide in water for 1 hour as in Example 1. The effective polymer cation to sulfur content molar ratio is about 2, and the expected hydrolytic strength retention is about 80%, more than Example 1, and further reflecting the impact of time and concentration on the final results. The results from Tables 1 and 2 are shown graphically in FIG. 2.

TABLE 2

| | Example | | |
|---|---|---|---|
| | 2 | 3 | 4 |
| S (wt %) | 1.8 | 0.5 | 0.2 |
| Na (wt %) | 0.7 | 0.7 | 0.28 |
| Ca (ppm) | 35 | 35 | 35 |
| K (ppm) | 20 | 20 | 15 |
| Cl (ppm) | 100 | 100 | 100 |
| S (moles/kg) | 0.6 | 0.2 | 0.1 |
| Na (moles/kg) | 0.3 | 0.3 | 0.1 |
| Ca (moles/kg) | Trace | Trace | Trace |

TABLE 2-continued

| | Example | | |
|---|---|---|---|
| | 2 | 3 | 4 |
| K (moles/kg) | Trace | Trace | Trace |
| Cl (moles/kg) | Trace | Trace | Trace |
| [Na] + 2[Ca] + [K] − [Cl]/[S] | 0.5 | 1.9 | 1.9 |
| Expected Hydrolytic Strength Retention (%) | 55 | 80 | 80 |

Example 5

In a continuous process a yarn is made as described above, however each yarn has 270 filaments with each filament having a linear density of 3 denier. The coagulated yarn is continuously washed in 10 sequential wash modules, each having set of two rolls with spirally advancing wrap, with 20 wraps per module. All of the modules except for module 8 washes the yarn with water at ~60° C. Module 8 washes the yarn with 2.0 weight percent NaOH in water. The residence time in each wash module is about 35 seconds, with the total wash time being about 350 seconds. Excess liquid is then removed from the yarn with a pin dewaterer and the yarn is dried on dryer rolls in an oven at 160° C. The yarn is then heat treated under nitrogen in a first oven at 300° C. and 4.5 cN/dtex and then a second oven at 450° C. and 0.15 cN/dtex. The effective polymer cation to sulfur content molar ratio is about 1 and expected hydrolytic strength retention is about 70%.

What is claimed:

1. A method for obtaining high-tenacity aramid yarn, wherein the yarn is made of a copolymer obtained from a mixture of monomers comprising 5-(6)-amino-2-(p-aminophenyl)benzimidazole, an aromatic para-diamine, and an aromatic para-diacid; said method comprising:

a) spinning a dope solution comprising said copolymer and sulfuric acid to produce the aramid yarn;

b) washing said yarn with a basic solution for at least 5 a time period of greater than 20 seconds; and c) heating said yarn; wherein the yarn is heated in at least two process steps, characterized in that in a first step the yarn is heated at a temperature of 200 to 360° C. at a tension of at least 0.2 cN/dtex, followed by a second step wherein the yarn is heated at a temperature of 370 to 500° C. at a tension of less than 1 cN/dtex, wherein the hydrolytic strength retention of the yarn is greater than 60%; and wherein the hydrolytic strength retention is computed by dividing the strength of a skein of yarn treated with saturated steam at 150° C. for 24 hours by the strength of an untreated skein of yarn and multiplying by 100.

2. The method of claim 1 further comprising washing said yarn with water before and after contacting said yarn with said basic aqueous solution.

3. The method of claim 1, wherein the first heating step is performed at 240 to 330° C. at a tension of at least 3 cN/dtex.

4. The method of claim 1, wherein the second heating step is performed at 400 to 470° C. at a tension less than 0.5 cN/dtex.

5. The method of claim 1, wherein the copolymer is obtained from a mixture of monomers at least comprising a) 5-(6)-amino-2-(p-aminophenyl)-benzimidazole, b)

terephthaloyl dichloride and/or 2-chloroterephthaloyl dichloride, and c) p-phenylene diamine and/or 2-chloro-p-phenylenediamine.

* * * * *